US006505919B1

(12) United States Patent
Mizutani

(10) Patent No.: US 6,505,919 B1
(45) Date of Patent: Jan. 14, 2003

(54) INK JET RECORDING HEAD AND INK JET RECORDING APPARATUS INCORPORATING THE SAME

(75) Inventor: Hajime Mizutani, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/506,403

(22) Filed: Feb. 18, 2000

(30) Foreign Application Priority Data

Feb. 18, 1999 (JP) ..... 11-040686
Jan. 14, 2000 (JP) ..... 2000-006598

(51) Int. Cl.[7] ..... B41J 2/045
(52) U.S. Cl. ..... 347/70; 310/330; 310/332
(58) Field of Search ..... 347/68, 69, 70, 347/71, 72; 310/330, 332

(56) References Cited

U.S. PATENT DOCUMENTS 3,438,021 A * 4/1969 Nelkin et al. ..... 310/330
4,730,197 A 3/1988 Raman et al. ..... 346/140
5,530,465 A * 6/1996 Hasegawa et al. ..... 347/70

FOREIGN PATENT DOCUMENTS

EP 0 738 599 10/1996 ..... B41J/2/045
EP 0890440 * 1/1999
JP 5-286131 11/1993 ..... B41J/2/045

OTHER PUBLICATIONS

The online materials information resource [Online], [retrieved on Jun. 27, 2001] Retrieved from the internet:<http://www.matweb.com/SpecificMaterial.asp?bassnum=CCHAN3&group=General>.*

The online materials information resource [Online], [retrieved on Jun. 27, 2001] Retrieved from the internet:<http://www.matweb.com/SpecificMaterial.asp?bassnum=MEPt00&group=General>.*

* cited by examiner

*Primary Examiner*—John Barlow
*Assistant Examiner*—Ly T Tran
(74) *Attorney, Agent, or Firm*—Sughrue Mion, PLLC

(57) ABSTRACT

A pressure generating chamber communicating with a nozzle orifice from which ink is to be ejected. A vibration plate constitutes at least a part of the pressure generating chamber. A piezoelectric element includes a lower electrode constituting at least a part of the vibration plate, a piezoelectric layer formed on the lower electrode, an upper electrode formed on the piezoelectric layer, and an active part for actuating the vibration plate to eject the ink from the nozzle orifice. A neutral plane of the actuation of the active part is located in the vibration plate.

17 Claims, 11 Drawing Sheets

INK JET RECORDING HEAD AND INK JET RECORDING APPARATUS INCORPORATING THE SAME

BACKGROUND OF THE INVENTION

The present invention relates to an ink jet recording head wherein a vibration plate, on the surface of which piezoelectric elements are formed, constitutes one part of a pressure generating chamber that communicates with nozzle orifices from which ink droplets are ejected when the piezoelectric elements are displaced, and relates as well to an ink jet recording apparatus incorporating the recording head.

In two types of ink jet recording heads that are now in practical use, vibration plates form parts of pressure generating chambers that communicate with nozzle orifices. When such a vibration plate is distorted in response to the vibration of a piezoelectric element, pressure is applied to ink in a pressure generating chamber and a drop of ink is ejected through an associated nozzle orifice. The head types for which vibration plates are used are: an ink jet recording head that employs piezoelectric actuators, in a vertical vibration mode, that are extended or compressed in the axial direction of the piezoelectric elements; and an ink jet recording head that employs piezoelectric actuators in a flexure vibration mode.

In the first head type, which is appropriate for high-resolution printing, the volumes of pressure generating chambers are changed by bringing end faces of piezoelectric elements into contact with a vibration plate. However, to manufacture this first type, a number of difficult procedures must be preformed, including the cutting of piezoelectric material to provide a comb-tooth-shaped device, which corresponds to the pitches of a nozzle orifice array, and the positioning and securing of the obtained piezoelectric element relative to the pressure generating chambers. Accordingly, the manufacturing process is complicated.

As for the second ink jet recording type, only a comparatively simple process, which involves the attachment of a piezoelectric green sheet having a shape that corresponds to the position of pressure generating chambers and the annealing of the resultant structure, is required to provide piezoelectric elements for a vibration plate. However, since flexure vibration is employed, specific areas are to a degree required, and providing for a high-resolution array is difficult.

To resolve the shortcomings of the second ink jet recording head, as proposed in Japanese Patent Publication No. 5-286131A, a thin-film formation technique is used to deposit a uniform piezoelectric layer across the entire surface of the vibration plate. A lithographic method is then used to subdivide the piezoelectric layer to provide shapes that match those of the pressure generating chambers and to form independent piezoelectric elements for the individual pressure generating chambers.

According to this method, the process by which piezoelectric elements are adhered to a vibration plate is not required, and the piezoelectric elements themselves can be formed using a precise and easily employed procedure, such as lithography. Further, since the piezoelectric elements that are produced in this way are thin, they are suitable for high-speed driving. In this case, while the piezoelectric layer that is deposited covers the entire surface of a vibration plate, only the upper electrode is formed for each pressure generating chamber. With this arrangement, the piezoelectric elements corresponding to the individual pressure generating chambers can be driven.

However, according to the manufacturing method for which the thin-film formation technique and the lithographic process are used, generally, the piezoelectric layer is formed so that it is thicker than the vibration plate in order to improve its piezoelectric characteristics. Therefore, when the piezoelectric elements are driven, the deforming efficiency is reduced by a neutral plane that is located inside the piezoelectric layer. As a result, the force of the displacement produced by the piezoelectric layer can not satisfactorily be converted into a force that can be used to eject ink.

SUMMARY OF THE INVENTION

To resolve this problem, it is one objective of the invention to provide an ink jet recording head that can more efficiently employ the force of the displacement developed when piezoelectric elements are driven, and an ink jet recording apparatus incorporating the recording head.

In order to achieve the above object, according to a first aspect of the present invention, there is provided an ink jet recording head comprising:

- a pressure generating chamber communicating with a nozzle orifice from which ink is to be ejected;
- a vibration plate constituting at least a part of the pressure generating chamber; and
- a piezoelectric element including:
- a lower electrode constituting at least a part of the vibration plate;
- a piezoelectric layer formed on the lower electrode; and
- an upper electrode formed on the piezoelectric layer, wherein an active part of the piezoelectric element for actuating the vibration plate to eject ink from the nozzle orifice is situated so as to face the pressure generating chamber, and wherein a neutral plane of the actuation of the piezoelectric element is located in the vibration plate.

Here, the vibration plate may be made of a ductile material. The vibration plate and the lower electrode may be made of the same material.

According to the first aspect, since the neutral plane is not located in the piezoelectric layer, only the force produced by compression is exerted by the piezoelectric layer that is driven, and the deforming efficiency provided by the piezoelectric elements is increased.

According to a second aspect of the invention, in the ink jet recording head of the first aspect, the following relationship is satisfied.

$$E_s D^2 > E_f d^2$$

where

- $E_f$: Young's modulus for the piezoelectric film and the upper electrode film
- $E_s$: Young's modulus for the vibration plate
- d: total thickness of the piezoelectric film and the upper electrode
- D: thickness of the vibration plate Preferably, the above relationship is satisfied in the active part of the piezoelectric element.

According to the second aspect, since the neutral plane is precisely positioned in the vibration plate, the deforming efficiency is improved.

According to a third aspect of the invention, in the ink jet recording head of the second aspect, $E_s D^2$ is 1 to 50 times as large as $E_f d^2$.

According to the third aspect, since the above relationship is defined within a predetermined range, the deforming efficiency is even more improved.

According to a fourth aspect of the invention, in the ink jet recording head of the first to the third aspects, the tensile stress of the lower electrode is greater than the stress of the piezoelectric layer.

According to the fourth aspect, the displacement of the piezoelectric layer due to the stress of the lower electrode is protected from being hindered.

According to a fifth aspect of the invention, in the ink jet recording head of the fourth aspect, the stress of the piezoelectric layer is tensile stress, and the tensile stress of the lower electrode is one to three times the tensile stress of the piezoelectric layer.

According to the fifth aspect, the displacement of the piezoelectric layer due to the stress of the lower electrode is more precisely protected from being hindered.

According to a sixth aspect of the invention, in the ink jet recording head of the first to the fifth aspects, the tensile stress of the upper electrode is greater than the stress of the piezoelectric layer.

According to the sixth aspect, the displacement of the piezoelectric layer due to the stress of the upper electrode is protected from being hindered.

According to a seventh aspect of the invention, in the ink jet recording head of the sixth aspect, the stress of the piezoelectric layer is tensile stress, and the tensile stress of the upper electrode is one to three times as large as the tensile stress of the piezoelectric layer.

According to the seventh aspect, the displacement of the piezoelectric layer due to the stress of the upper electrode is more precisely protected from being hindered.

According to an eighth aspect of the invention, in the ink jet recording head of the first to the seventh aspects, the thickness of the vibration plate is thicker than at least a total thickness of the active part of the piezoelectric film and the upper electrode.

The ink jet recording head may further comprise an insulating layer formed on the piezoelectric element. Here, the thickness of the vibration plate is thicker than a total thickness of the active part of the piezoelectric film, the upper electrode and the insulating layer. Preferably, the above relationship is satisfied in the active part of the piezoelectric element.

According to the eighth aspect, the positioning of the neutral plane in the vibration plate is ensured, and the deforming efficiency is improved.

According to a ninth aspect of the invention, in the ink jet recording head according to the first to the eighth aspects, the vibration plate includes, at the least, either a metal oxide film or a brittle film, and due to the driving of the piezoelectric member active unit, the neutral plane of the actuation of the piezoelectric element is located in the metal oxide film or in the brittle material film.

According to the ninth aspect, the stress that is imposed on the vibration plate is suppressed, and damage to or deterioration of the vibration plate can be prevented.

According to a tenth aspect of the invention, in the ink jet recording head of the ninth aspect, the brittle material film is made of zirconium oxide.

According to the tenth aspect, since the brittle film wherein the neutral plane is located is formed of a specific material, its destruction due to stress during displacement can be prevented.

According to an eleventh aspect of the invention, in the ink jet recording head of the ninth aspect, the metal oxide film is made of silicon oxide.

According to the eleventh aspect, since the metal oxide film wherein the neutral plane is located is formed of a specific material, its destruction due to stress during displacement can be prevented.

According to a twelfth aspect of the invention, in the ink jet recording head of the first to the eleventh aspects, the pressure generating chamber is formed in a monocrystalline silicon substrate by anisotropic etching, and the laminated structure of the piezoelectric element is formed by using a film formation technique and a lithographic process.

According to the twelfth aspect, a large number of ink jet recording heads having high resolution arrangements of nozzle orifices can be manufactured comparatively easily.

According to a thirteenth aspect of the invention, there is provided an ink jet recording apparatus comprising ink jet recording heads defined in the first to the twelfth aspects.

According to the thirteenth aspect, an ink jet recording apparatus having a greater number of reliable heads can be provided.

DETAILED DESCRIPTION OF THE PREFERRED EMBODIMENTS

Figure 1:
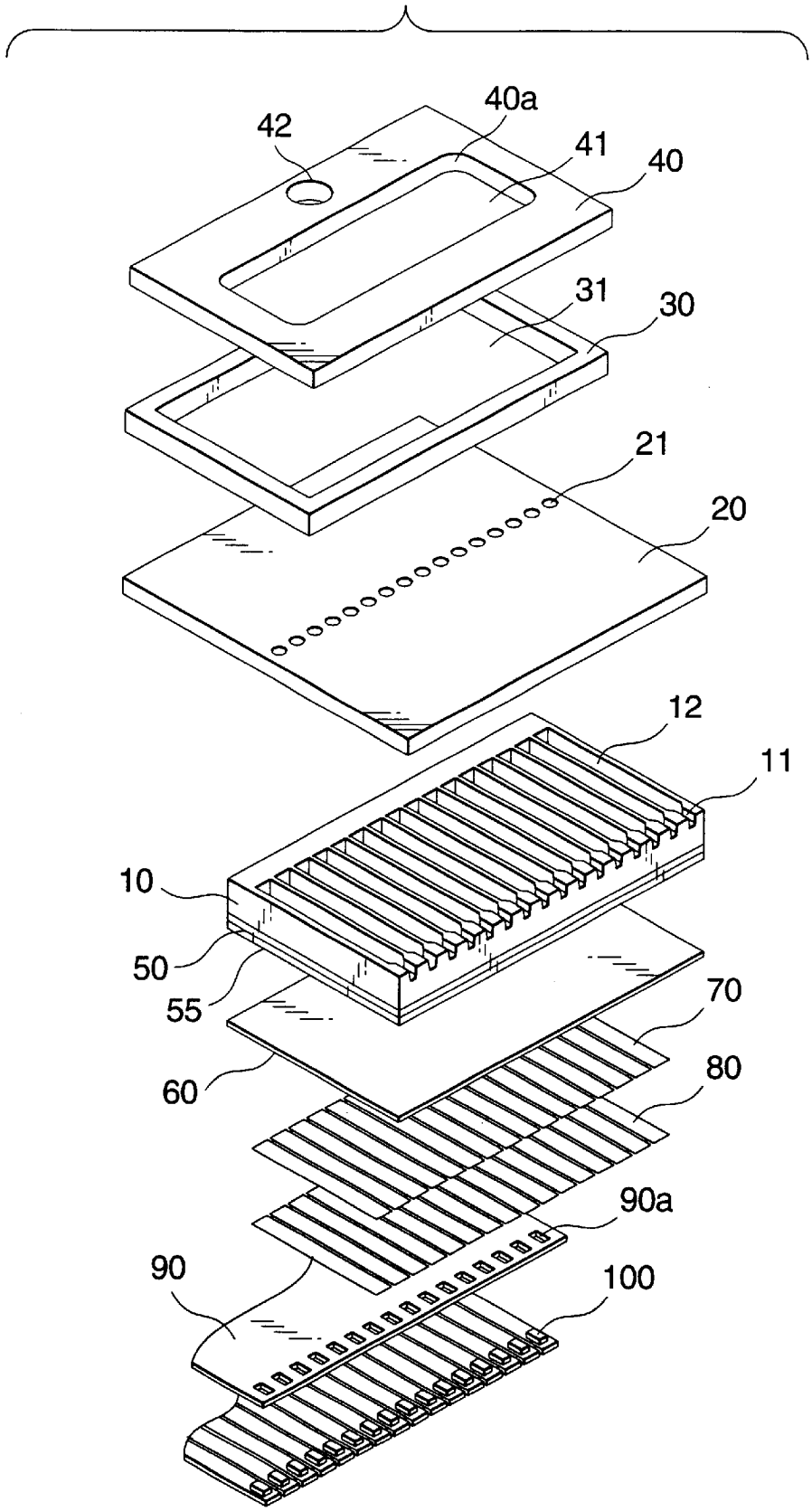
FIG. 1 is an exploded perspective view showing an ink jet recording head according to one embodiment of the invention.
Figure 2A:
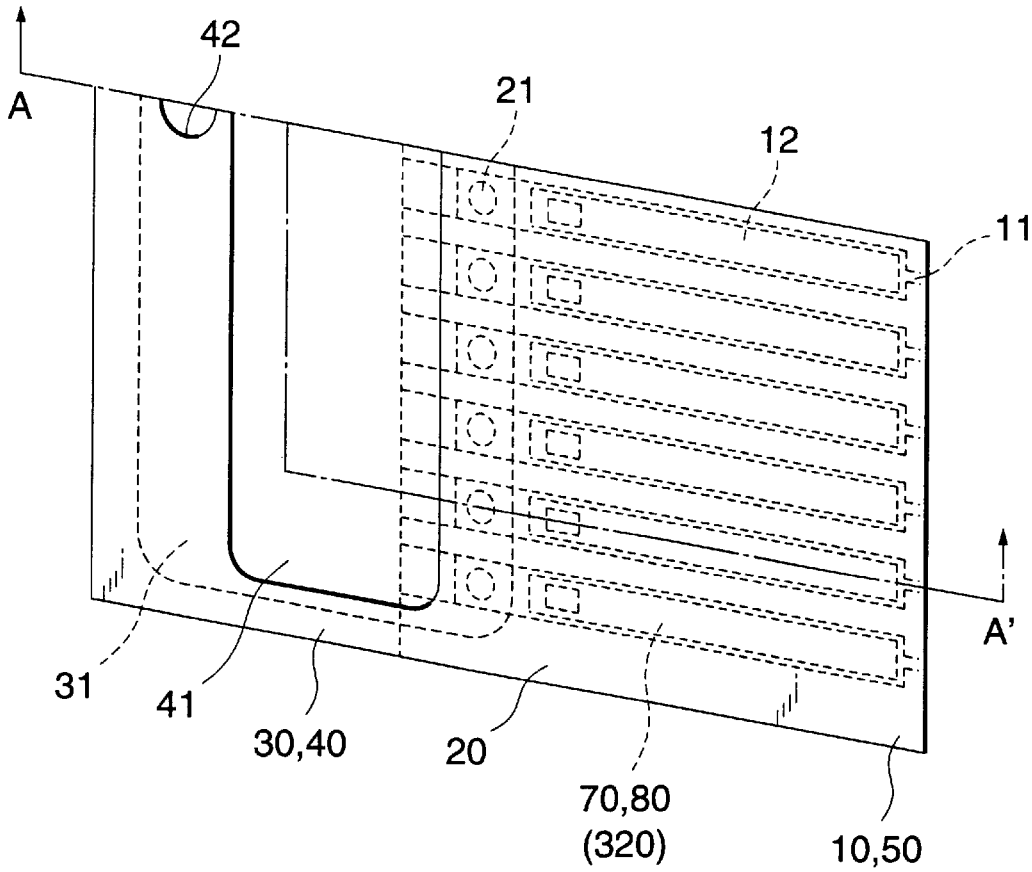
FIG. 2A is a plan view showing the ink jet recording head of FIG. 1.
Figure 2B:
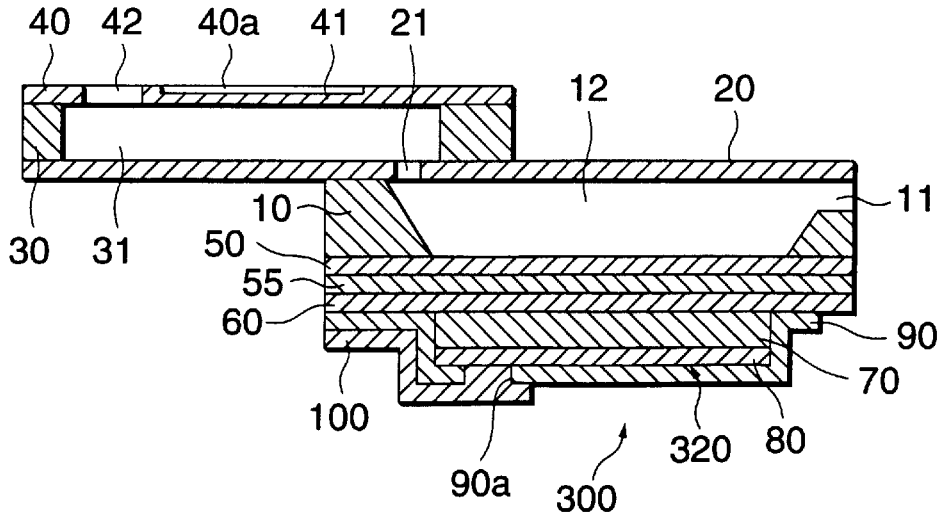
FIG. 2B is a section view showing the ink jet recording head of FIG. 1.

FIG. 1 is an exploded perspective view of an ink jet recording head according to a first embodiment of the present invention. FIG. 2A is a plan view, and FIG. 2B is a longitudinal section view of one pressure generating chamber.

As is shown in FIG. 1, a channel formation substrate 10 in this embodiment is a silicon crystal substrate having a plane index (110). Generally, a channel formation substrate 10 having a thickness of 150 to 300 $\mu$m is employed, while a thickness of approximately 220 $\mu$m is preferable. This is because the array density can be increased, while the rigidity of the partition wall between the adjacent pressure generating chambers is maintained.

One face of the channel formation substrate 10 serves as an opening face, while formed on the other face of the substrate 10 is an elastic film 50, which is made of silicon dioxide that is obtained in advance by thermal oxidization, having a thickness of 1 to 2 $\mu$m.

Nozzle orifices 11 and pressure generating chambers 12 in the opening face of the channel formation substrate 10 are formed by anisotropic etching of the silicon crystal substrate.

In this case, the anisotropic etching is performed by utilizing the following characteristics: when the silicon crystal substrate is immersed in an alkaline solution, such as KOH, gradual erosion of the substrate occurs, and a first plane (111) and a second plane (111) appear; a first plane (111) is perpendicular to the plane (110), while a second plane (111) forms with the first plane (111) an angle of approximately 70 degrees, and forms with the plane (110) an angle of approximately 35 degrees; and the etching rate of the plane (111) is about 1/180 of the etching rate of the plane (110). As a result of the anisotropic etching, fine processing can be performed by using, as the basis, depth processing to provide a parallelogram shaped structure, the sides of which comprise two first faces (111) and, obliquely, two second faces (111). Therefore, a high resolution arrangement of pressure generating chambers 12 can be provided.

In this embodiment, the long sides of each pressure generating chamber 12 are formed by first faces (111), while the short sides are formed by second faces (111). The pressure generating chambers 12 are formed by etching the channel formation substrate 10 until the elastic film 50 is reached. It should be noted that only an extremely small amount of the elastic film 50 is immersed into an alkaline solution when the silicon crystal substrate is etched.

The nozzle orifices 11 that are formed are narrower and shallower than the pressure generating chambers 12, and each of them communicates with one end of a pressure generating chamber 12. That is, a nozzle orifice 11 is formed by etching (half-etching) the silicon crystal substrate to a degree in the direction of its thickness. It should be noted that the half-etching is performed by adjusting the etching time.

The size of a pressure generating chamber 12 wherein pressure is applied to ink to eject ink droplets, and the sizes of nozzle orifices 11, through which ink droplets are ejected are optimized in accordance with the volume of the ejected ink droplets, the ejection speed and the droplet ejection frequency. When, for example, 360 ink droplets are to be ejected per inch, the nozzle orifices 11 must be precisely formed at intervals of several tens of $\mu$m.

Furthermore, the pressure generating chambers 12 communicate with a common ink reservoir 31 via ink supply ports 21 that are formed in a sealing plate 20, which will be described later, at positions corresponding to an end of each pressure generating chamber 12. Ink from the common ink reservoir 31 is supplied to the individual pressure generating chambers 12 via the ink supply ports 21.

Figure 3A:
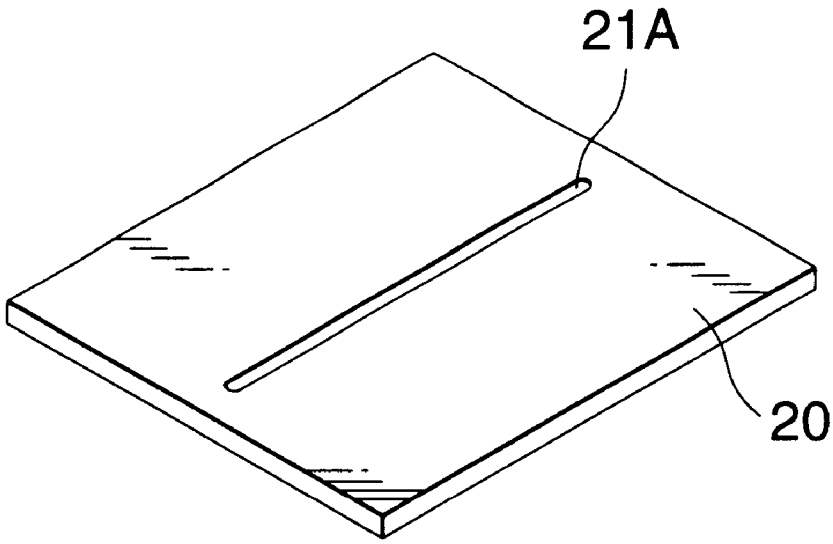
FIGS. 3A and 3B are perspective views showing variations of the sealing plate of FIG. 1.
Figure 3B:
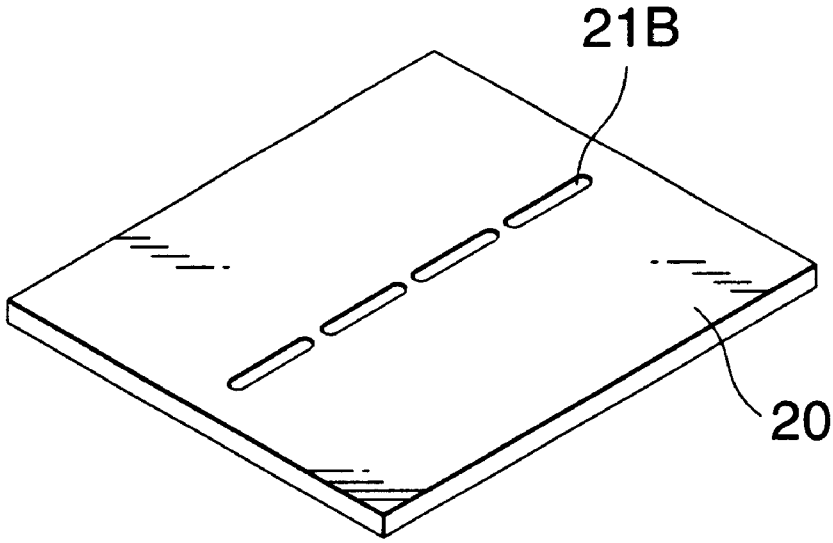

The sealing plate 20, in which ink supply ports 21 are formed at locations corresponding to the pressure generating chambers 12, is made of a glass ceramic. The sealing plate 20 has a thickness of 0.1 to 1 mm, and a linear expansion coefficient of 2.5 to 4.5 [$\times 10^{-6}$/° C.] at a temperature that is equal to or less than 300° C. As is shown in FIGS. 3A and 3B, the ink supply ports 21 may be provided as a single slit 21A or as a plurality of latitudinally formed slits 21B that extend across and communicate with the ink supply port ends of the pressure generating chambers 12. One face of the sealing plate 20 covers the entire face of the channel formation substrate 10, and serves as a reinforcement plate to protect the silicon crystal substrate from damage due to a shock or the external force. The other face of the sealing plate 20 constitutes one wall of the common ink reservoir 31.

A reservoir formation substrate 30 forms the peripheral walls of the common ink reservoir 31, and is manufactured by die cutting a satisfactorily thick stainless steel plate that is consonant with the number of nozzle orifices and the ink droplet ejection frequency. In this embodiment, the reservoir formation substrate 30 has a thickness of 0.2 mm.

One face of a reservoir side plate 40, which is made of a stainless steel substrate, forms one wall of the common ink reservoir 31, and in the other face a recessed portion 40*a* is formed using half etching so that only a thin wall 41 remains. In addition, die cutting is used to form an ink introduction port 42 through which externally supplied ink enters the common ink reservoir 31. The thin wall 41 is used to absorb the pressure that is exerted to the side opposite the nozzle orifices 11 when ink droplets are ejected. The thin wall 41 prevents undesired positive or negative pressure from being transmitted via the common ink reservoir 31 to the individual pressure generating chambers 12. In this embodiment, taking into account the rigidity required to connect the ink introduction port 42 to an external ink supplier, the reservoir side plate 40 has a thickness of 0.2 mm, which at the thin wall 41 is reduced to a thickness of 0.02 mm. However, to eliminate the half etching process that is performed to form the thin wall 41, the reservoir side plate 40 may originally have a thickness of 0.02 mm.

An insulating film 55, having a thickness, for example, of 0.1 to 2 $\mu$m, is deposited on the side of the elastic film 50 facing away from the opening face of the channel formation substrate 10, and on this insulating film 55 a lower electrode film 60 having a thickness, for example, of approximately 0.2 $\mu$m, a piezoelectric film 70 having a thickness, for example, of approximately 1 $\mu$m, and an upper electrode film 80 having a thickness, for example, of approximately 0.1 $\mu$m are laminated using a process that will be described later. In this manner, a piezoelectric element 300 is provided. It should be noted that the piezoelectric element 300 is the portion that includes the lower electrode film 60, the piezoelectric film 70 and the upper electrode film 80. Generally, one electrode for the piezoelectric element 300 is formed and used as a common electrode, and patterning is used to form for each of the generation chambers 12 another electrode and the piezoelectric film 70. In this embodiment, a piezoelectric active part 320 is the portion that includes the electrode and the piezoelectric film 70 that are formed by patterning, and that is piezoelectrically distorted by the application of a voltage to the two electrodes. Also in this embodiment, the lower electrode film 60 is defined as the common electrode for the piezoelectric element 300, while the upper electrode film 80 is defined as the individually provided electrode for the piezoelectric element 300. The functions of these electrodes, however, may be reversed if the drive circuit and wiring are altered. Furthermore, in this embodiment, the piezoelectric element 300 and the vibration plate that is displaced when the piezoelectric element 300 is driven are together called a piezoelectric actuator. And the elastic film 50, the insulating film 55 and the lower electrode film 60 together function as the vibration plate.

An explanation will now be given, while referring to FIG. 4, for a process by which the piezoelectric film 70 is formed on the channel formation substrate 10, which is a silicon crystal substrate.

Figure 4A:
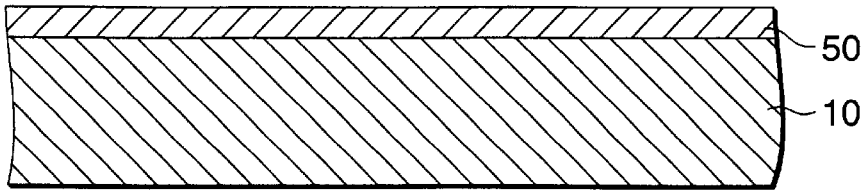
FIGS. 4A to 6C are section views showing a thin film formation process.

As is shown in FIG. 4A, first, a silicon crystal substrate wafer that will serve as the channel formation substrate 10 is thermally oxidized in a diffusion furnace at approximately 1100° C., and the elastic film 50, which is made of silicon dioxide, is deposited on the substrate 10.

Figure 4B:
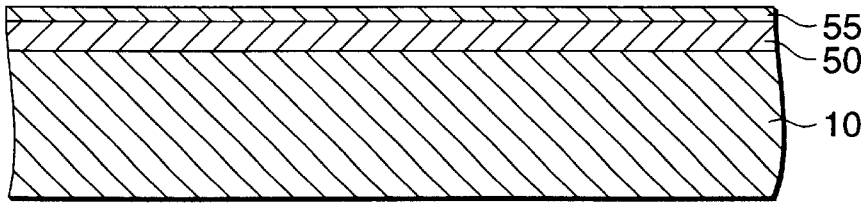

Then, as is shown in FIG. 4B, the insulating film 55 is deposited on the elastic film 55. It is preferable that the insulating film 55 be formed of a material, e.g., an oxide or nitride of at least one element that is selected from the elements of the piezoelectric film 70, that can be satisfactorily attached to the piezoelectric film 70. In this embodiment, a zirconium layer is deposited on the elastic film 50, and then, in the diffusion furnace, the resultant structure is thermally oxidized at approximately 1150° C. to obtain an insulating film 55 that is made of zirconium dioxide.

Figure 4C:
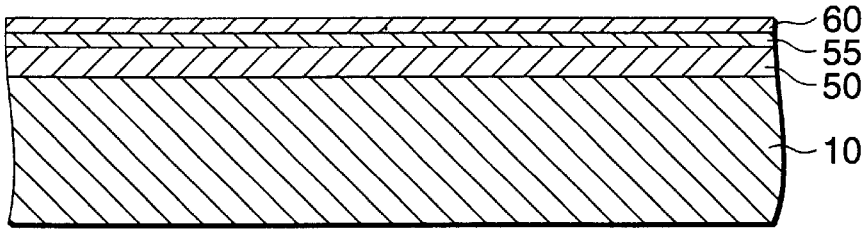

Following this, as is shown in FIG. 4C, the lower electrode film 60 is formed by sputtering. Platinum is an appropriate material for the lower electrode film 60 because the piezoelectric film 70, formed by sputtering or the sol-gel method, which will be described later, must be crystallized by annealing it at a temperature of 600 to 1000° C. under normal atmospheric conditions or in an oxygen rich atmosphere. That is, the material of the lower electrode film 60 must maintain its conductivity at a high temperature in an oxygen rich atmosphere. Especially when titanate zirconate (PZT) is employed as the piezoelectric film 70, the change in the conductivity due to the diffusion of an oxidizing flame is preferably small. For this reason, platinum is the appropriate material.

Figure 4D:
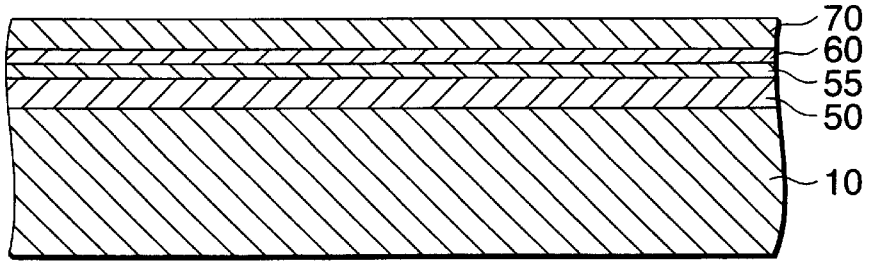

Next, as is shown in FIG. 4D, the piezoelectric film 70 is deposited. For this, a so-called sol-gel method is employed in this embodiment. According to this method, a coating of a so-called sol, produced by heating and diffusing an organic metal in a solvent, is applied and dried to obtain a gel, and the gel is then annealed at a high temperature to obtain a piezoelectric film 70 of metal oxide. Note that a PZT material is appropriate for the piezoelectric film 70 when it is employed for an ink jet recording head. The method used to deposit the piezoelectric film 70 is not specifically limited, and the sputtering method may be also employed.

An additional method may be employed whereby the PZT precursor film is first formed using the sol-gel method or sputtering, and then a high-pressure process, during which the film is immersed in an alkaline solution, is employed to induce the growth of crystals at a low temperature.

Figure 4E:
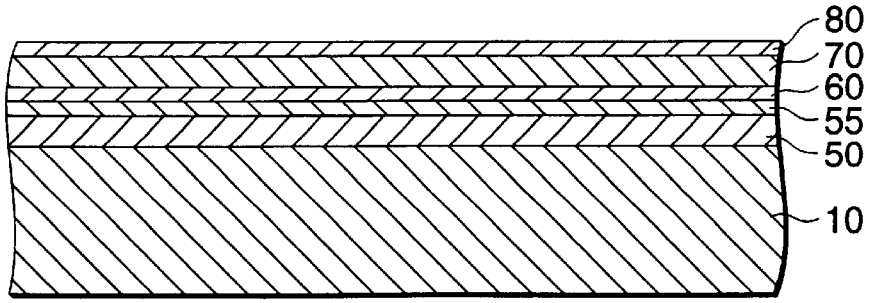

Finally, as is shown in FIG. 4E, the upper electrode film 80 is deposited. For this, a highly conductive material is used, and various metals, such as aluminum, gold, nickel and platinum, and a conductive oxide can be employed. In this embodiment, platinum is deposited by sputtering.

Figure 5A:
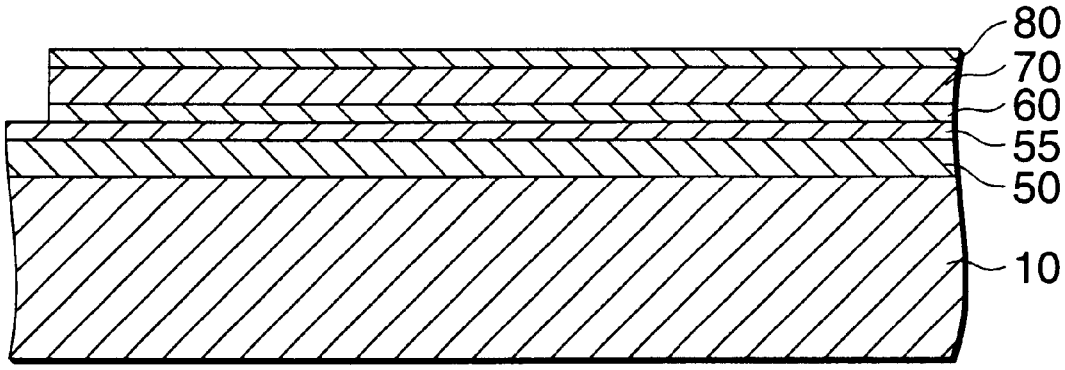
Figure 5B:
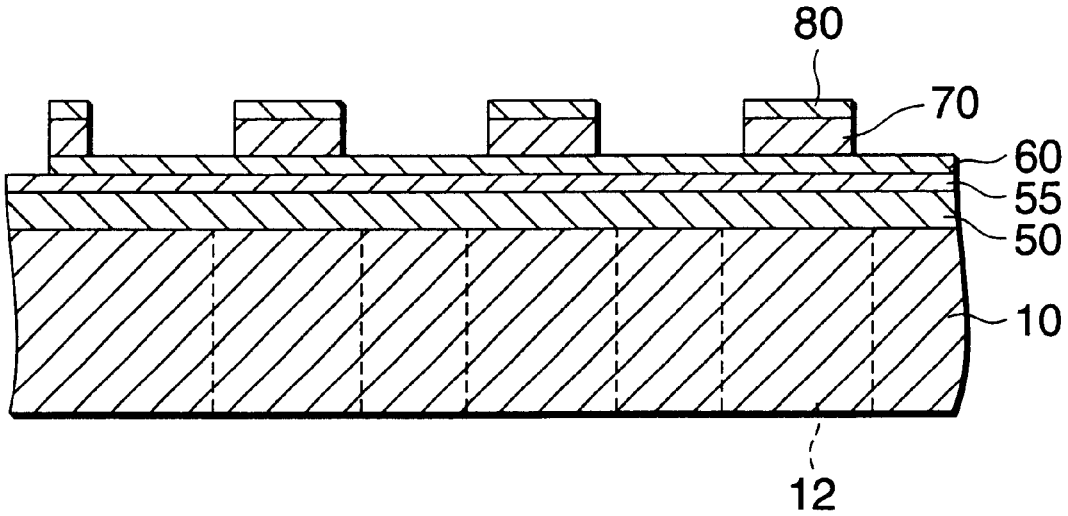

Then, the lower electrode film 60, the piezoelectric film 70 and the upper electrode film 80 are patterned as is shown in FIGS. 5A and 5B.

Specifically, as is shown in FIG. 5A, the lower electrode 60, the piezoelectric film 70 and the upper electrode film 80 are etched together to pattern the entire lower electrode film 60. Following which, as is shown in FIG. 5B, only the piezoelectric films 70 and the upper electrode films 80 are etched to pattern the active part 320 of the piezoelectric element 300.

As is described above, after the lower electrode film 60 has been patterned, the active part 320 is patterned, and this completes the patterning process.

After the patterning of the lower electrode film 60 and the piezoelectric member active units 320 has been completed, it is preferable that an inter-layer insulating film 90 be deposited that covers, at the least, the peripheral edges of the top face of each upper electrode film 80 and the side faces of each piezoelectric film 70 (see FIG. 1).

Figure 6A:
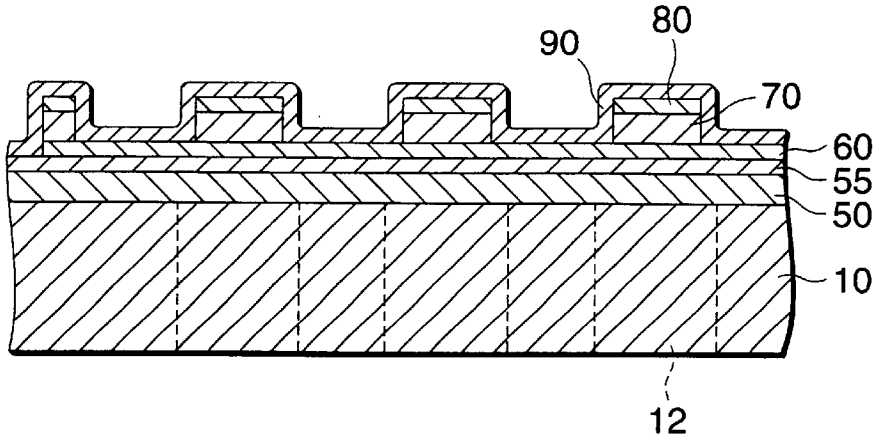
Figure 6B:
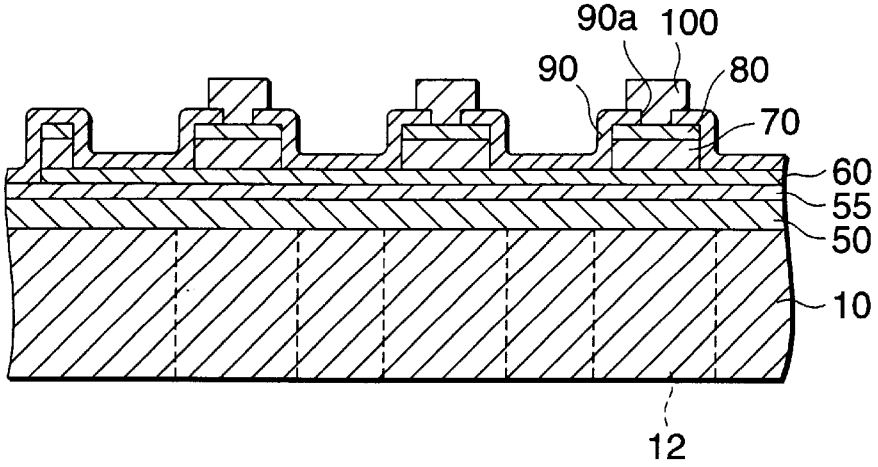
Figure 6C:
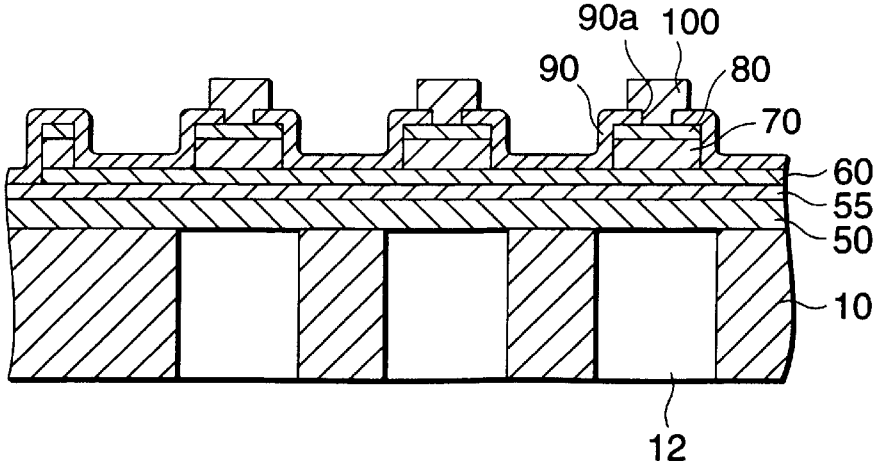

The process employed to deposit such an insulating layer is shown in FIGS. 6A to 6C.

First, as is shown in FIG. 6A, the inter-layer insulating film 90 is deposited so that it covers the peripheral edges of the upper electrode films 80 and the side faces of the piezoelectric films 70. In this embodiment, a negative photosensitive polyimide is used for the inter-layer insulating film 90.

Then, as is shown in FIG. 6B, the inter-layer insulating film 90 is patterned, and contact holes 90*a* are formed in the vicinity of ends of the corresponding pressure generating chambers 12, the side of which ink is supplied. The contact holes 90*a* are used for the connection of lead electrodes 100 to the upper electrode films 80. One end of each lead electrode 100 is connected to a corresponding upper electrode film 80, and the other end extends outward to contact the connection terminal. The lead electrodes 100 are formed so that the ends are narrow and can thus precisely supply drive signals to the upper electrode films 80 they contact. In this embodiment, the contract holes 90*a* are formed at positions corresponding to the pressure generating chambers 12. However, the piezoelectric films 70 and the upper electrode films 80 may be extended downward to the peripheral walls of the pressure generating chambers 12, and the contact holes 90*a* may be formed at positions corresponding to the peripheral walls.

When the deposition process has been completed, as is shown in FIG. 6C, to form the pressure generating chambers 12, anisotropic etching, using the alkaline solution, of the silicon crystal substrate is performed.

The arrangement of the wiring used to drive the active part 320 of the piezoelectric element 300 is not specifically limited. That is, in this example, the lower electrode film 60 is extends across the entire surface, and the piezoelectric film 70 and the upper electrode film 80 are patterned so that the areas they cover correspond to the pressure generating chambers 12. However, the piezoelectric films 70 and the upper electrode films 80 may be externally extended from the ends of the pressure generating chambers 12, so that formation of contact holes is not required. Further, the lower electrode film 60 may also be patterned so that the areas covered correspond to the pressure generating chambers 12. An arbitrary wiring arrangement can also be employed.

In the film deposition process sequence and the anisotropic etching described above, multiple chips are simultaneously formed on a single wafer, and after the process has been terminated, the wafer is cut to provide the one-chip channel formation substrate 10 shown in FIG. 1. Thereafter, to provide an ink jet recording head, the obtained channel formation substrate 10 is sequentially bonded to the sealing plate 20, the reservoir formation substrate 30, and the reservoir side plate 30.

The thus arranged ink jet recording head receives ink through the ink introduction port 42, which communicates with an external ink supplier (not shown), and the ink filling the common ink reservoir 31 is transferred internally until it reaches the nozzle orifices 11. Then, when in accordance with a recording signal from an external driver (not shown) a voltage is applied via the lead electrode 100 to the lower electrode film 60 and an upper electrode 80, the elastic film 50, the insulating film 55, the lower electrode film 60 and a piezoelectric film 70 are deformed. And as a result, the pressure in a pressure generating chamber 12 is increased and an ink droplet is ejected through a nozzle orifice 11.

Figure 7A:
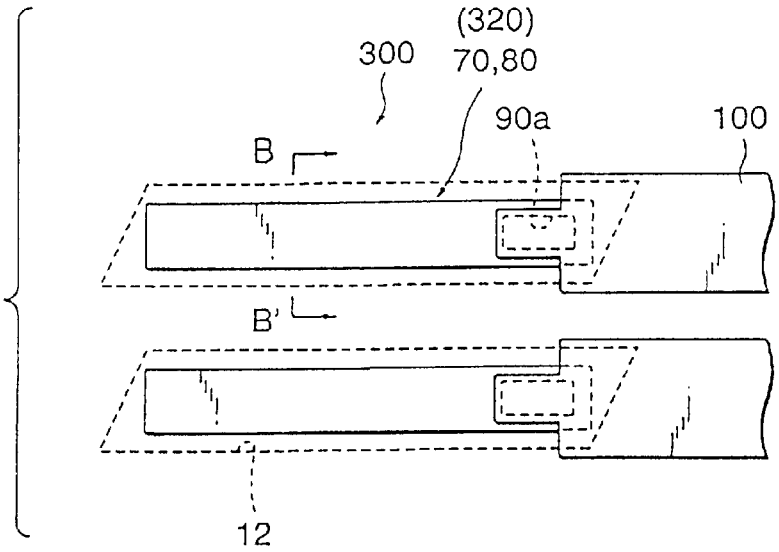
FIG. 7A is a plan view showing an active part of a piezoelectric actuator.
Figure 7B:
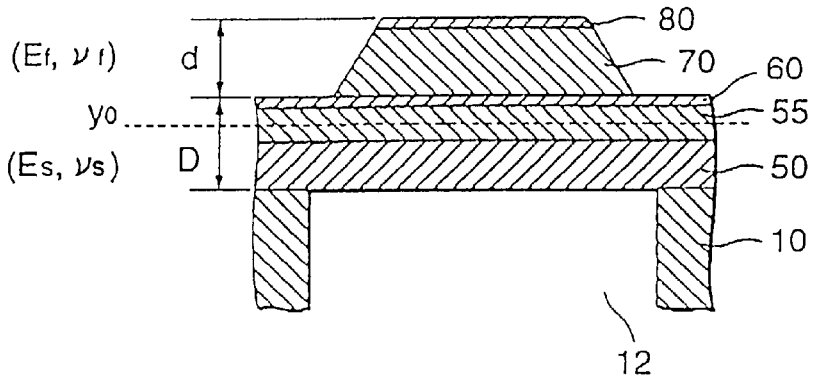
FIG. 7B is a section view showing the active part of FIG. 7A.

FIGS. 7A and 7B are a plan view and a section view of the essential portion of the ink jet recording head in this embodiment.

As is shown in FIGS. 7A and 7B, which is a section view taken along line B–B' in FIG. 7A, in this embodiment the piezoelectric element 300, which is constituted by the lower electrode film 60, the piezoelectric films 70 and the upper electrode films 80, is provided in an area opposite the pressure generating chambers 12, and serves as the active part 320 of the piezoelectric element 300. In the vicinity of the longitudinal end of the active part 320, the upper electrode films 80 are connected to lead electrodes 100 via the contact holes 90*a* in the inter-layer insulating film 90, which is deposited on the active part 320.

In this embodiment, as is described above, the insulating film 55 is made of zirconium oxide and is deposited so that it occupies all the area between the elastic film 50 and the lower electrode film 60, which is one of the electrodes of the active part 320 of the piezoelectric element 300, and together, the elastic film 50, the insulating film 55 and the lower electrode film 60 serve as the vibration plate. The vibration plate is formed so that it is thicker than the piezoelectric film 70 and the upper electrode film 80 of the active part 320, and thus, when the active part 320 is driven, the neutral plane is positioned in the vibration plate. That is, in this embodiment, as is indicated by the broken line, the thickness' of the individual layers that constitute the vibration plate are adjusted, so that when the active part 320 is driven, the neutral plane $y_0$ is located inside the insulating film 55.

When the boundary plane between the vibration plate (the lower electrode film 60) and the piezoelectric film 70 is used as a reference, the neutral plane $y_0$ is represented by expression (1).

$$y_0 = \frac{\int_{-D}^{0} \frac{E_s}{1-\nu_s} y dy + \int_{0}^{d} \frac{E_f}{1-\nu_f} y dy}{\frac{E_s}{1-\nu_s} d + \frac{E_f}{1-\nu_f} y dy} \tag{1}$$

Here, $E_f$: Young's modulus for the piezoelectric film and the upper electrode film;

$E_s$: Young's modulus for the vibration plate $\nu_f$: Poisson ratios for the piezoelectric film and the upper electrode $\nu_s$: Poisson ratio for the vibration plate d: Total thickness of the piezoelectric film and the upper electrode D: Thickness of the vibration plate By using this expression, the thickness' of the individual layers are determined in accordance with the specific characteristics, such as Young's modulus and the Poisson ratios for the layers, so that the relationship $y_0<0$ is established. As a result, the neutral plane can be positioned inside the vibration plate. The Young modulus and the Poisson ratios of the vibration plate and the piezoelectric film are approximately 0.2 to 0.3 and the denominator is always a positive value. Therefore, when the thickness' of the piezoelectric layer and the vibration plate are determined in accordance with their characteristics, so that the relationship of expression (2) is established, the neutral plane can be positioned inside the vibration plate.

$$\int_0^D \frac{E_s}{1-\nu_s} y dy > \int_0^d \frac{E_f}{1-\nu_f} y dy \tag{2}$$

That is, only the thickness' of the individual layers need be determined, so that the product of Young's modulus for the vibration plate and the square of the film thickness is greater than the product of Young's modulus for the upper electrode films 80 and the piezoelectric films 70 and the square of the film thickness. It is especially preferable that the product of Young's modulus for the vibration plate and the square of the film thickness be 1 to 50 times as large as the product of Young's modulus for the upper electrode films 80 and the piezoelectric films 70 and the square of the film thickness. As a result, the displacement of the vibration plate when the piezoelectric element is driven can be improved.

When a vibration plate is displaced by the application of a voltage to a piezoelectric film 70, the piezoelectric film 70 is stiffened in accordance with the displacement, and Young's modulus seems to be increased. Also in this case, it is preferable that the thickness' of the individual layers be determined in accordance with the characteristics of the layers, so as to satisfy the expression (2).

In this embodiment, the thickness' of the layers that constitute the vibration plate are adjusted, and the neutral plane is positioned in the vibration plate. However, the method that can be used is not thereby limited, and when the piezoelectric film is formed, the thickness of the upper electrode film 80 that is to be formed may be determined in accordance with the characteristics and thickness' of the individual layers. As a result, the neutral plane can be easily and definitely positioned inside the vibration plate. At this time, when the insulating film 55 is formed of zirconium oxide, which is comparatively thick or hard, the thickness of the upper electrode film 80 can be more easily adjusted.

Even when the insulating film 55 that is deposited is hard or thick, so long as it is practically employed, it does not adversely affect the displacement of the vibration plate that occurs when the piezoelectric element is driven. Further, when the rigidity of the vibration plate is increased and the deformation amount is reduced because of the thickness of the vibration plate that has been formed, to cope with this problem the width of the pressure generating chambers must be increased.

Further, the neutral plane can be positioned in the vibration plate by suitably selecting the cross-sectional shape of the piezoelectric film. Namely, according to the present invention, the neutral plane is resultantly positioned in the vibration plate by selecting at least one of the physical property, the film thickness, the cross-sectional shape of the respective films suitably within the scope of the invention.

Further, it is preferable that at least one of the electrodes that are formed on the surface of the piezoelectric film 70, e.g., the lower electrode film 60, have a tensile stress that is greater than that of the piezoelectric film 70. And it is especially preferable that when tensile stress is applied to the piezoelectric film 70, that the tensile stress placed on the lower electrode film 60 be 1 to 3 times that applied to the piezoelectric film 70. Similarly, it is preferable that the tensile stress applied to the upper electrode film 80 be greater than that placed on the piezoelectric film 70. It is also especially preferable that when tensile stress is placed to the piezoelectric film 70, that the tensile stress applied to the upper electrode film 80 be 1 to 3 times that placed on the piezoelectric film 70. Therefore, the deformation of the piezoelectric film 70 can be protected from being hindered, and as a result, the efficiency of the deformation of the piezoelectric film 70 can be improved.

When the active part 320 of the piezoelectric element 300 of the thus arranged ink jet recording head is driven by application of a voltage, with the neutral plane $y_0$ acting as a boundary, compression stress is exerted on the vibration plate, and the layers of the active part 320 nearer the upper electrode film 80, while tension stress is applied to the side of the elastic film 50. Therefore, as in this embodiment, when the neutral plane $y_0$ is positioned inside the vibration plate, only the compression stress is exerted on the piezoelectric film 70 when the active part 320 is driven. Therefore, the displacement force produced by the piezoelectric film 70 can be satisfactorily converted into an ink ejection force, and the drive voltage can be reduced.

In addition, in this embodiment, the neutral plane $y_0$ is specifically positioned inside the insulating film 55, which is composed of a brittle material, i.e., the insulating film 55, composed of a brittle material, is positioned in an area wherein the least stress is concentrated. Therefore, when the active part 320 of the piezoelectric element 300 is driven, the stress exerted on the vibration plate is reduced, and the destruction or the deterioration of the vibration plate can be prevented.

The present invention is not limited to the above embodiment. For example, the vibration plate may be provided as a layer constituted only by the lower electrode. Namely, the vibration plate may be made of a ductile material such as platinum so as to be suitable for tensile stress.

Figure 8:
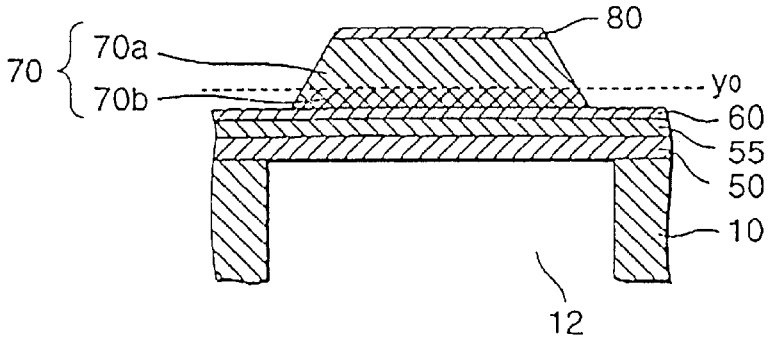
FIG. 8 is a section view shown an active part of a piezoelectric actuator incorporated in a related ink jet recording head.

When, as in the conventional art, the neutral plane is positioned in the piezoelectric film 70, as is shown in FIG. 8, tensile stress is exerted on a piezoelectric film 70*b* that is nearer the elastic film 50, even though greater compression stress is exerted on a piezoelectric film 70*a* that is nearer the upper electrode film 80 than the neutral plane. Therefore, the displacement force of the piezoelectric film 70 can not be satisfactorily converted into an ink ejection force, and deterioration of the deforming efficiency occurs.

A specific example of the ink jet recording head for this embodiment is shown below.

In this embodiment, to satisfy the expression (2), the vibration plate and the individual layers of the piezoelectric element were formed in accordance with the characteristics and thickness' shown in Table 1, so that an ink jet recording head was provided wherein the neutral plane $y_0$ was positioned inside the vibration plate.

As comparison examples, the vibration plate and the individual layers of the piezoelectric element were formed in accordance with the characteristics and thickness' shown in Table 1, while the other conditions were the same as in the embodiment. Ink-jet recording heads were thereby provided wherein the neutral plane $y_0$ was positioned outside the vibration plate.

TABLE 1

| | | Embodiment | Comparison Example 1 | Comparison Example 2 |
|---|---|---|---|---|
| Elastic film | Young's modulus [GPa] | 75 | 75 | 75 |
| | Thickness [μm] | 1 | 1 | 1 |
| Insulating film | Young's modulus [GPa] | 150 | 150 | 150 |
| | Thickness [μm] | 0.5 | 0.4 | 0.5 |
| Lower electrode film | Young's modulus [GPa] | 200 | 200 | 100 |
| | Thickness [μm] | 0.5 | 0.4 | 0.5 |

TABLE 1-continued

| | | Embodiment | Comparison Example 1 | Comparison Example 2 |
|---|---|---|---|---|
| Piezoelectric film | Young's modulus [GPa] | 68 | 68 | 100 |
| | Thickness [μm] | 2 | 2 | 2 |
| Upper electrode film | Young's modulus [GPa] | 200 | 200 | 200 |
| | Thickness (μm) | 0.1 | 0.3 | 0.1 |
| $\frac{S_1}{S_2} = \frac{E_s D^2}{E_f d^2}$ | | 1.4 | 0.5 | 0.7 |

For the ink jet recording head of the embodiments and the comparison examples, the piezoelectric element was driven by the application of a voltage of 25 V, and the deformation amount and the deforming efficiency (deforming energy per unit length upon the application of a voltage of 25 V) of the vibration plate were measured. It should be noted that in Comparison example 1, the film thickness was changed while the distortion and Young's modulus were constant, and that in Comparison example 2, Young's modulus was changed, while the film thickness and the distortion were constant. The obtained results are shown in Table 2.

TABLE 2

| | Embodiment | Comparison Example 1 | Comparison Example 2 |
|---|---|---|---|
| Deformation amount for vibration plate upon application of voltage of 25 V [nm] | 248.4 | 190.8 | 213.0 |
| Deforming energy per unit length upon application of 25 V [J] | $9.86 \times 10^{-9}$ | $6.62 \times 10^{-9}$ | $8.10 \times 10^{-9}$ |

As is apparent from Table 2, in the embodiment wherein the neutral plane was positioned inside the vibration plate, the deformation amount and the deforming energy were considerably improved compared with the comparison examples. That is, when the neutral plane is positioned inside the vibration plane, the deforming efficiency of the vibration plate that obtain when the piezoelectric element is driven can be considerably improved.

One embodiment of the present invention has been explained; however, the basic structure of the ink jet recording head is not limited to that described in this embodiment.

Figure 9:
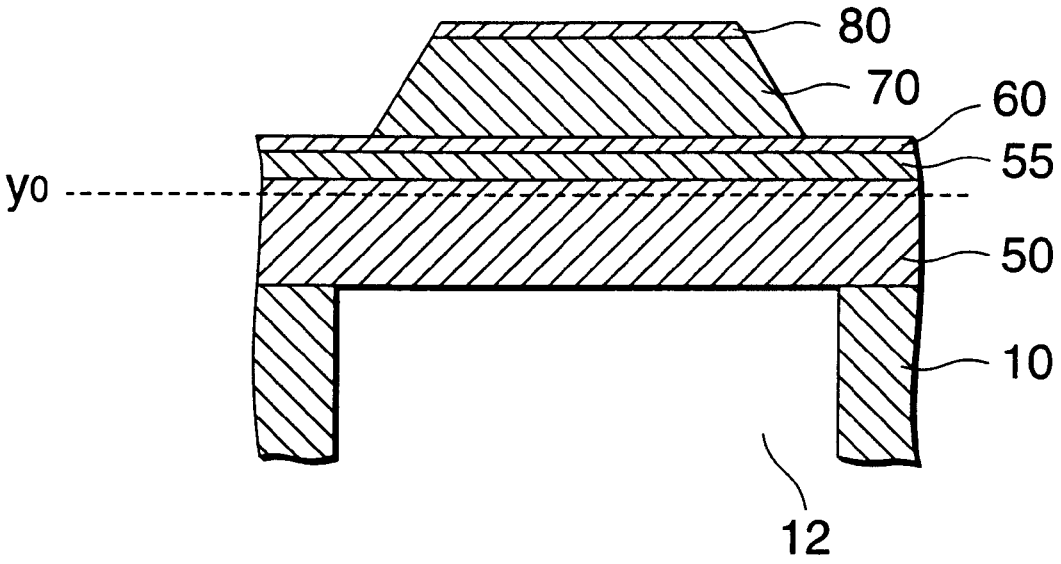
FIG. 9 is a section view showing an active part of a piezoelectric actuator according to another embodiment of the invention.

In the above embodiment, the neutral plane is positioned inside the insulating film 55 of the vibration plate. However, the positioning of the neutral plane is not thereby limited, and as is shown in FIG. 9, for example, the thickness' of the individual layers of the vibration plate may be adjusted, and as indicated by the broken line, the neutral plane $y_0$ may be positioned inside the elastic film 50. Further, the neutral plane $y_0$ may also be positioned inside the lower electrode film 60. So long as the neutral plane $y_0$ is positioned inside the vibration plate, the deforming efficiency can be increased, as it is in the above embodiment.

Furthermore, the reservoir formation substrate 30, as well as the sealing plate 20, may be made of glass ceramics, and the thin film 40 may be formed as a separate glass ceramic member. The materials and the structure can be freely altered.

In the above embodiment, the nozzle orifices are formed in the end face of the channel formation substrate 10.

However, the nozzle orifices may be formed so that they extend outward perpendicular to the end face.

Figure 10:
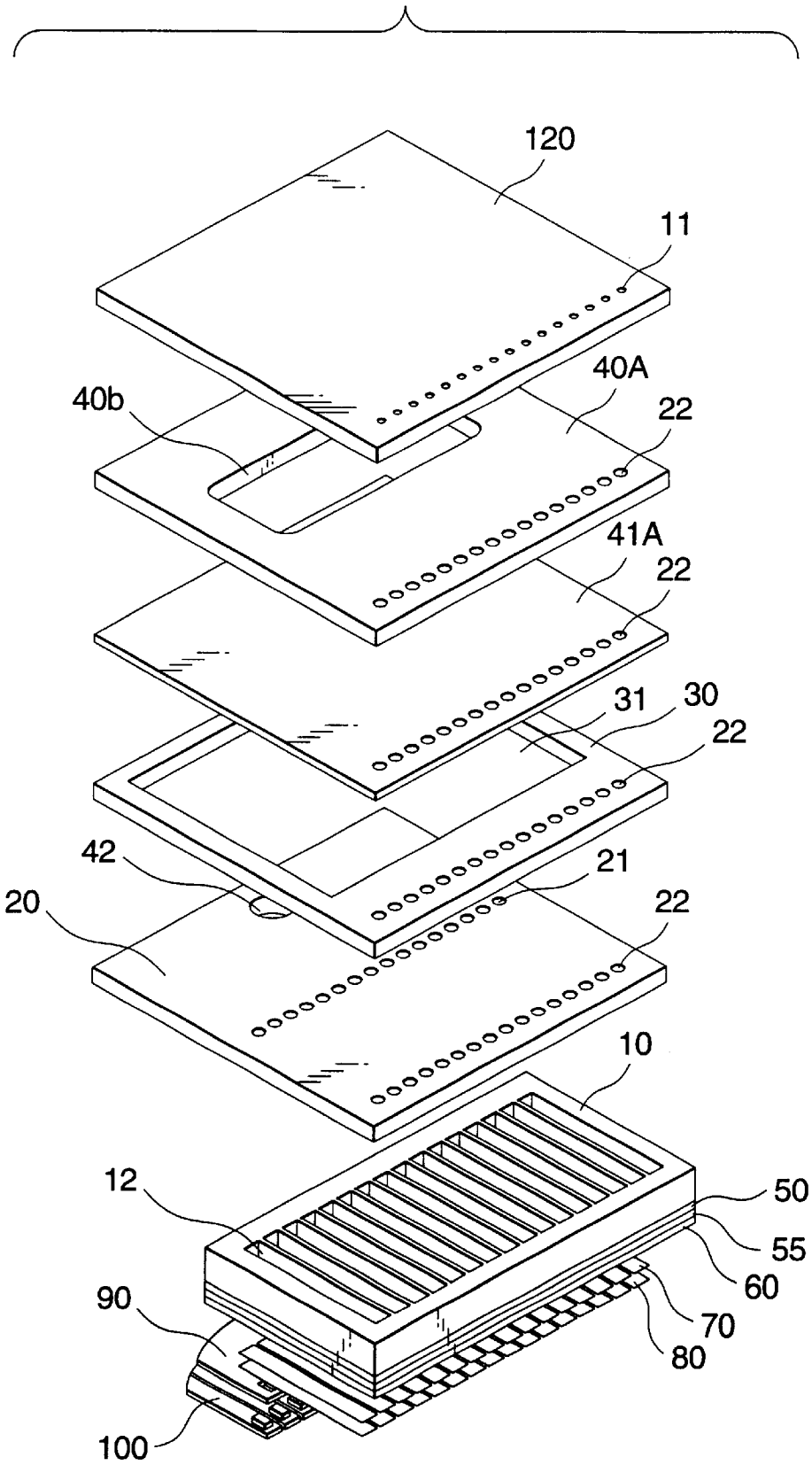
FIG. 10 is an exploded perspective view showing an ink jet recording head according to still another embodiment of the invention.
Figure 11:
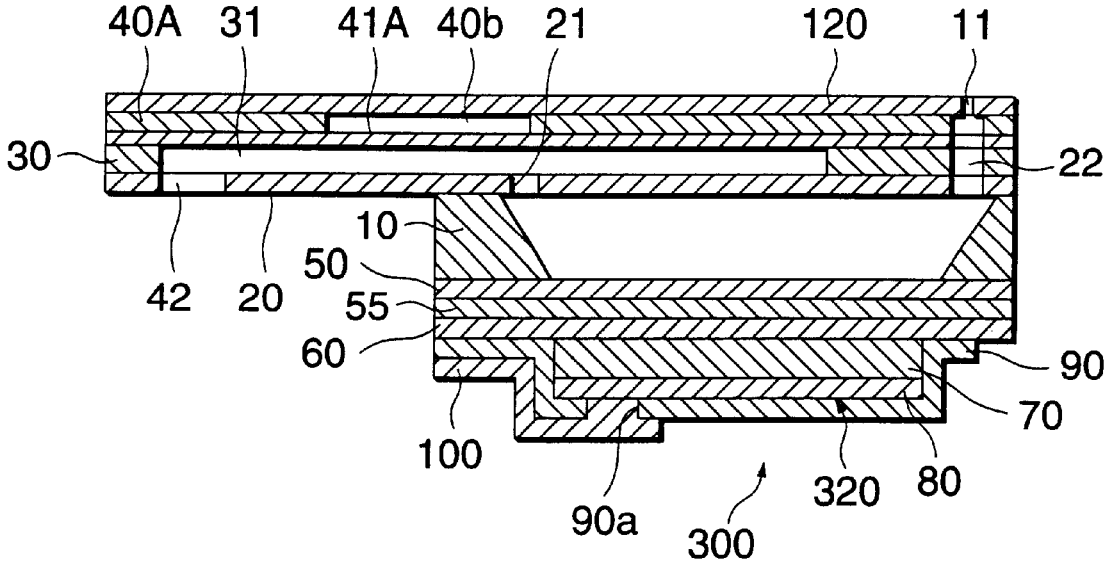
FIG. 11 is a section view showing the ink jet recording head of FIG. 10.

FIG. 10 is an exploded perspective view of the thus structured embodiment, and FIG. 11 is a section view of the flow passage. In this embodiment, nozzle orifices 11 are formed on a nozzle substrate 120 that is opposite the piezoelectric element, and nozzle communication ports 22, which connect the nozzle orifices 11 to pressure generating chambers 12, are formed that penetrate a sealing plate 20, a reservoir formation substrate 30, a thin plate 41A and a reservoir side plate 40A.

The arrangement of this embodiment is substantially the same as that of the first embodiment, except that the thin plate 41A and the reservoir side plate 40*a* are formed as separate members, and that an opening 40*b* is formed in the reservoir side plate 40A. The same reference numerals are also used to denote corresponding components, and no explanation for them will be given.

This embodiment can also be applied to an ink jet recording head wherein the common ink reservoir is formed in the channel formation substrate.

In the above described embodiment, a thin-film ink jet recording head is employed that can be manufactured by using the film deposition technique and a lithographic process. The present invention, however, is not limited to this type of ink jet recording head, since the present invention can also be applied for ink jet recording heads having various other arrangements, such as an ink jet recording head wherein pressure generating chambers are formed by lamination of substrates, an ink jet recording head wherein a piezoelectric film is deposited by adhering a green sheet or by screen printing, or an ink jet recording head wherein a crystal growth is used to deposit a piezoelectric film.

Furthermore, although in the above embodiments the inter-layer insulating film is formed between the piezoelectric element and the lead electrode, the arrangements that can be used are not thereby limited. For example, instead of forming the inter-layer insulating film, an anisotropic conductive film can be thermally welded to the upper electrodes and connected to the lead electrode. Either this, or various bonding techniques, such as wire bonding, can be employed for such connections.

As is described above, the present invention can be applied for various ink jet recording heads without departing from the scope of the subject of the invention.

Figure 12:
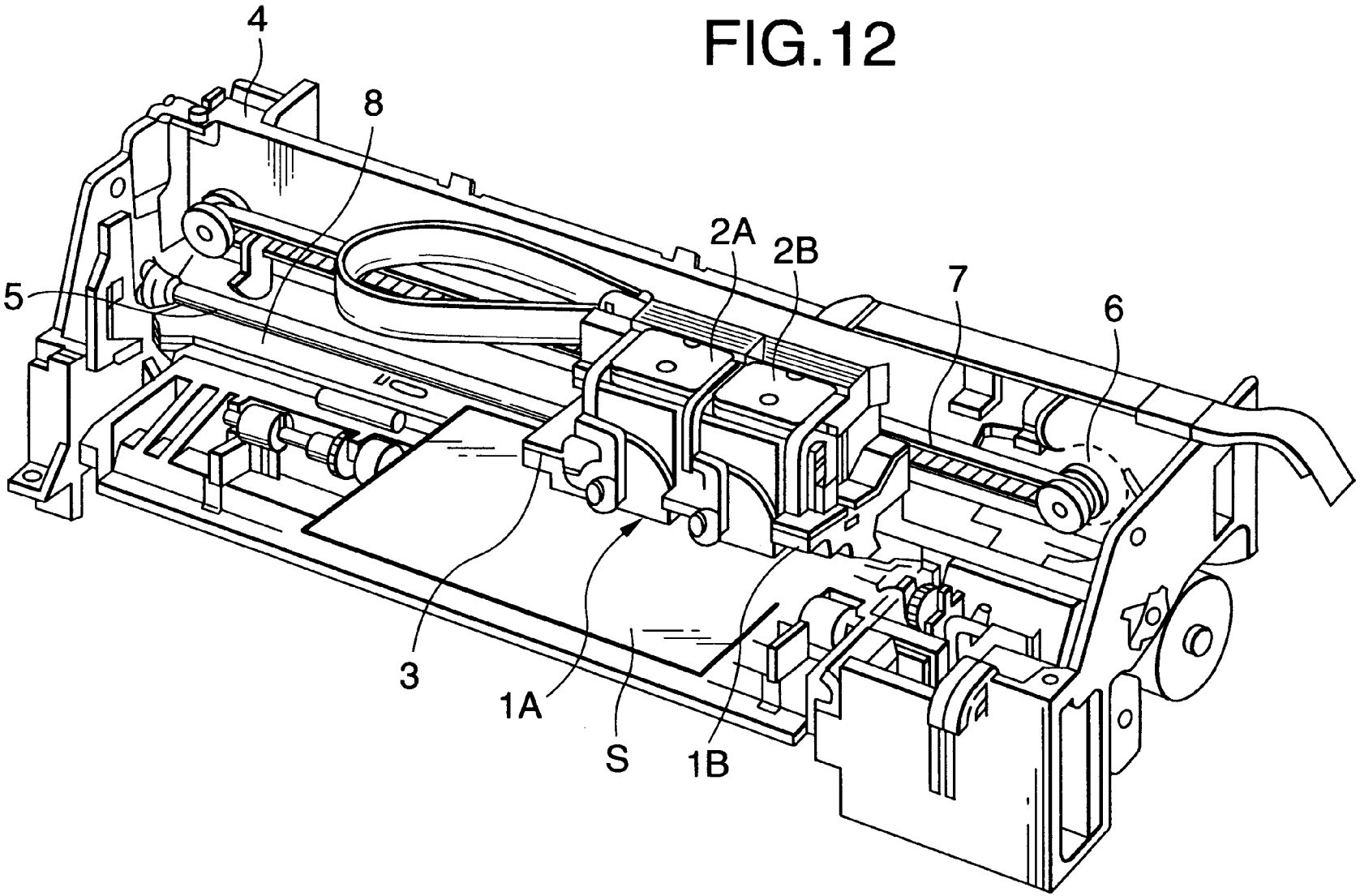
FIG. 12 is a schematic view showing an ink jet recording apparatus incorporating the ink jet recording head of the invention.

The ink jet recording head in each embodiment described above constitutes one part of a recording head unit, wherein an ink flow path is provided that communicates with an ink cartridge, that is incorporated in an ink jet recording apparatus. FIG. 12 is a schematic diagram illustrating an example ink jet recording apparatus.

As is shown in FIG. 12, cartridges 2A and 2B, which constitute ink supplier, are detachably mounted on recording head units 1A and 1B, each of which includes an ink jet recording head. A carriage 3, on which the recording head units 1A and 1B are mounted, is fitted around a carriage shaft 5, which is attached to a main body 4, so that it can slide freely in the axial direction. The recording head units 1A and 1B are respectively used to eject, for example, a black ink composition and colored ink compositions.

When the driving force of a drive motor 6 is transmitted to the carriage 3 via a plurality of gears (not shown) and a timing belt 7, the carriage 3, on which the recording head units 1A and 1B are mounted, is moved along the carriage shaft 5. Further provided for the main body 4, along the carriage shaft 5, is a platen 8 to which a recording sheet S, which is a recording medium such as paper, is supplied by a feed roller (not shown) and is thereafter conveyed while being held against the platen 8.

As is described above, according to the invention, since the neutral plane is positioned inside the piezoelectric film when the piezoelectric element is driven, the deforming efficiency of the piezoelectric film can be increased, and accordingly, the ink ejection efficiency can be improved. As a result, the drive voltage applied to the piezoelectric element can be reduced. And further, especially when the neutral plane is positioned inside a brittle material, when the piezoelectric element is driven the destruction and the deterioration of the brittle material is prevented.

What is claimed is:

1. An ink jet recording head, comprising:

a pressure generating chamber communicating with a nozzle orifice from which ink is to be ejected;

a vibration plate constituting at least a part of the pressure generating chamber; and a piezoelectric element including:

a lower electrode constituting at least a part of the vibration plate;

a piezoelectric layer formed on the lower electrode; and an upper electrode formed on the piezoelectric layer, wherein an active part of the piezoelectric element for actuating the vibration plate to eject the ink from the nozzle orifice is situated so as to face the pressure generating chamber;

wherein a neutral plane of the actuation of the piezoelectric element is located in the vibration plate; and wherein the following relationship is satisfied:

$$E_s D^2 > E_f d^2$$

where $E_f$: Young's modulus for the piezoelectric film and the upper electrode film $E_s$: Young's modulus for the vibration plate d: total thickness of the piezoelectric film and the upper electrode D: thickness of the vibration plate.

2. The ink jet recording head as set forth in claim 1, wherein $E_s D^2$ is 1 to 50 times as large as $E_f d^2$.

3. The ink jet recording head as set forth in claim 1, wherein the tensile stress of the lower electrode is greater than the stress of the piezoelectric layer.

4. The ink jet recording head as set forth in claim 3, the stress of the piezoelectric layer is tensile stress, and wherein the tensile stress of the lower electrode is one to three times as large as the tensile stress of the piezoelectric layer.

5. The ink jet recording head as set forth in claim 1, wherein the tensile stress of the upper electrode is greater than the stress of the piezoelectric layer.

6. The ink jet recording head as set forth in claim 5, wherein the stress of the piezoelectric layer is tensile stress, and wherein the tensile stress of the upper electrode is one to three times as large as the tensile stress of the piezoelectric layer.

7. The ink jet recording head as set forth in claim 1, wherein the thickness of the vibration plate is thicker than at least a total thickness of the active part of the piezoelectric film and the upper electrode.

8. The ink jet recording head as set forth in claim 7, further comprising an insulating layer formed on the piezoelectric element, wherein the thickness of the vibration plate is thicker than a total thickness of the active part of the piezoelectric film, the upper electrode and the insulating layer.

9. The ink jet recording head as set forth in claim 7, wherein the relationship is satisfied in the active part of the piezoelectric element.

10. The ink jet recording head as set forth in claim 1, wherein the vibration plate includes at least either a metal oxide film or a brittle film, and wherein the neutral plane of the actuation of the piezoelectric element is located in the metal oxide film or in the brittle material film.

11. The ink jet recording head as set forth in claim 10, wherein the brittle material film is made of zirconium oxide.

12. The ink jet recording head as set forth in claim 10, wherein the metal oxide film is made of silicon oxide.

13. The ink jet recording head as set forth in claim 1, wherein the pressure generating chamber is formed in a monocrystalline silicon substrate by anisotropic etching, and the laminated structure of the piezoelectric element is formed by using a film formation technique and a lithographic process.

14. The ink jet recording head as set forth in claim 1, wherein the relationship is satisfied in the active part of the piezoelectric element.

15. The ink jet recording head as set forth in claim 1, wherein the vibration plate is made of a ductile material.

16. The ink jet recording head as set forth in claim 15, wherein the vibration plate and the lower electrode is made of the same material.

17. An ink jet recording apparatus, comprising the ink jet recording head as set forth in any of the claims 1 to 16.

* * * * *